US007766122B2

(12) United States Patent
Graber

(10) Patent No.: US 7,766,122 B2
(45) Date of Patent: Aug. 3, 2010

(54) ACOUSTIC ENERGY PROJECTION SYSTEM

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 0 days.

(21) Appl. No.: 12/455,975

(22) Filed: Jun. 10, 2009

(65) Prior Publication Data

US 2009/0277712 A1 Nov. 12, 2009

Related U.S. Application Data

(62) Division of application No. 11/454,914, filed on Jun. 16, 2006, now Pat. No. 7,621,369.

(51) Int. Cl.
*G10K 11/28* (2006.01)

(52) U.S. Cl. ..... 181/191; 181/153; 181/155; 181/176; 381/336

(58) Field of Classification Search ..... 181/153, 181/155, 176, 188, 191; 381/335, 336, 387, 381/89

See application file for complete search history.

(56) References Cited

U.S. PATENT DOCUMENTS

| | | | |
|---|---|---|---|
| 3,898,384 | A | 8/1975 | Goeckel |
| 3,940,576 | A | 2/1976 | Schultz |
| 3,965,455 | A | 6/1976 | Hurwitz |
| 4,184,562 | A | 1/1980 | Bekamijilan |
| 4,348,750 | A | 9/1982 | Schwind |
| 4,434,507 | A | 2/1984 | Thomas |
| 4,588,042 | A | 5/1986 | Palet et al. |
| 4,796,009 | A | 1/1989 | Biersach |
| 4,836,328 | A | 6/1989 | Ferralli |
| 4,907,671 | A | 3/1990 | Wiley |
| 4,923,031 | A | 5/1990 | Carlson |
| 5,115,882 | A | 5/1992 | Woody |
| 5,144,670 | A | 9/1992 | Negishi |
| 5,146,508 | A | 9/1992 | Bader et al. |
| 5,173,942 | A | 12/1992 | Hirose |
| 5,220,608 | A | 6/1993 | Pfister |
| 5,616,892 | A | 4/1997 | Ferralli |
| 5,721,401 | A | 2/1998 | Sim |
| 5,793,001 | A | 8/1998 | Ferralli |
| 5,821,470 | A | 10/1998 | Meyer et al. |
| 5,898,138 | A | 4/1999 | Delgado, Jr. |
| 5,988,314 | A | 11/1999 | Negishi |
| 5,995,634 | A | 11/1999 | Zwolski |
| 6,009,972 | A | 1/2000 | Chot et al. |
| 6,257,365 | B1 | 7/2001 | Hulcobue, II |
| 6,597,797 | B1 | 7/2003 | Betts |
| 6,603,862 | B1 | 8/2003 | Betts |

*Primary Examiner*—Jeffrey Donels
*Assistant Examiner*—Jeremy Luks
(74) *Attorney, Agent, or Firm*—Paul W. O'Malley; Susan Firestone

(57) ABSTRACT

The sound generating and transmitting apparatus is based on a radiator including at least a first, and possibly two or more, shaped reflecting surface(s) having a forward radiant axis. Each of the shaped reflecting surfaces defines sets of equivalent acoustic input locations, with each set being a ring of non-zero circumference centered on the forward radiant axis. The sound source is a distributed, functionally continuous sound source adapted to exploit this feature. In its preferred form the sound source is a sort of closed line array of loudspeakers providing a toroidal shaped acoustic source to direct at the hyperbolic cone, the transducers being disposed in a circle with all of the loudspeakers oriented inwardly toward or outwardly from the forward radiant axis.

6 Claims, 16 Drawing Sheets

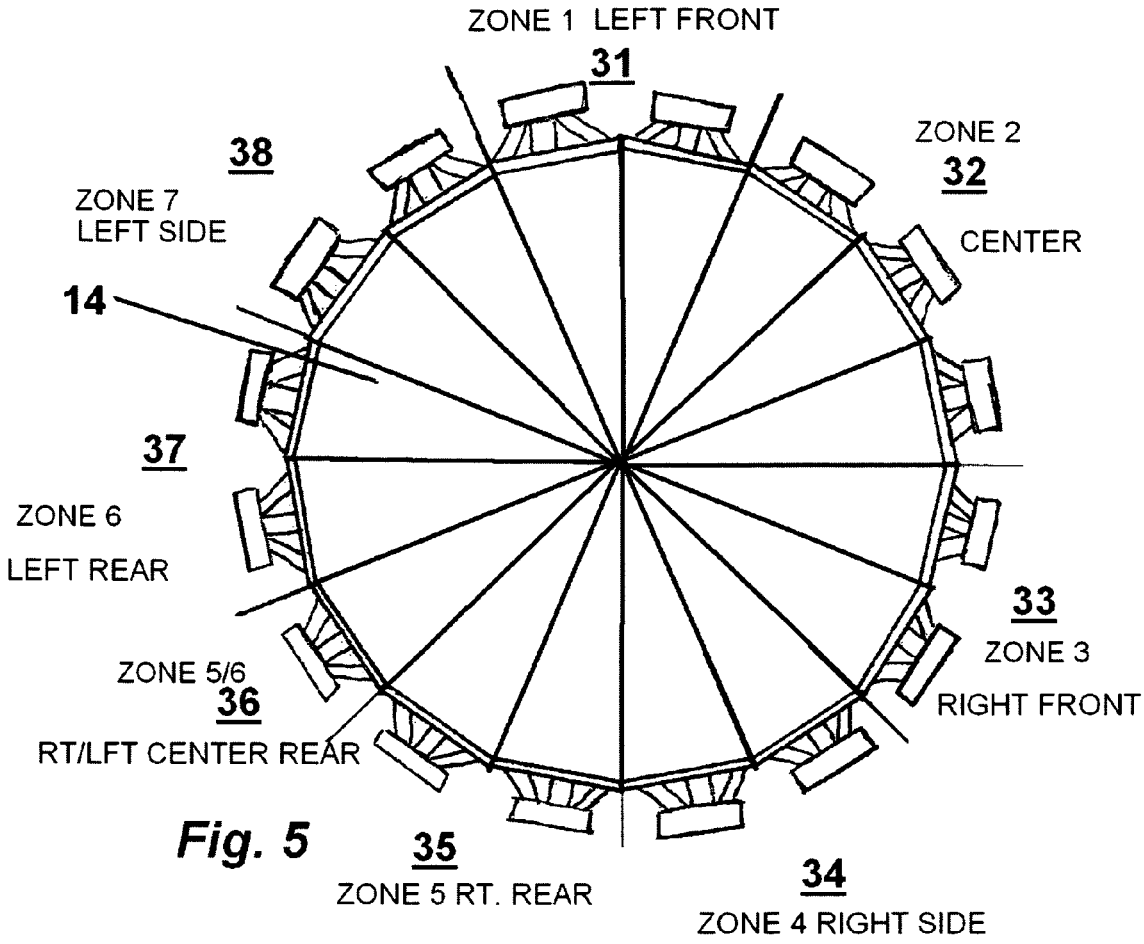
Fig. 5
Fig. 4
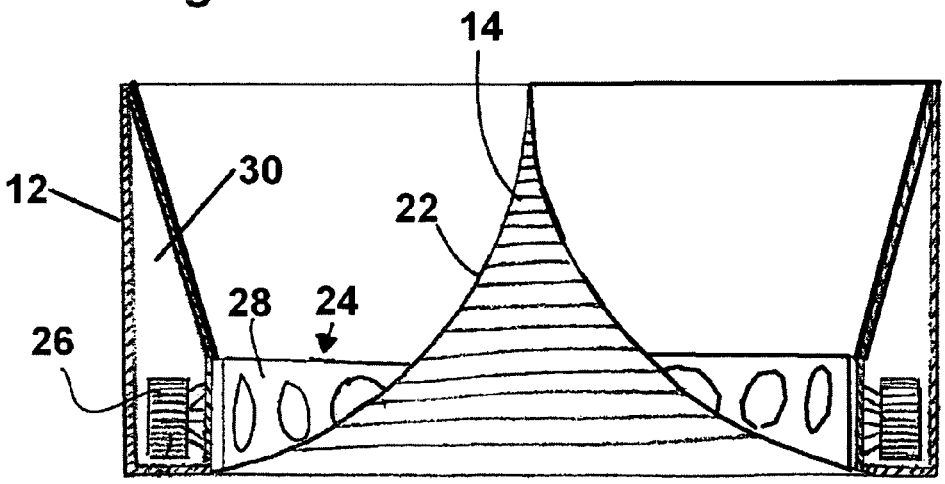

ACOUSTIC ENERGY PROJECTION SYSTEM

CROSS REFERENCE TO RELATED APPLICATION

The present application is a divisional of U.S. patent application Ser. No. 11/454,914 filed 16 Jun. 2006 now U.S. Pat. No. 7,621,369.

BACKGROUND OF THE INVENTION

1. Technical Field

The invention relates to a directional sound system and more particularly to an acoustic source and sound reinforcement system for delivering particularly intense sound energy to a remote location or for providing a particularly rich, but highly localized, surround-sound sound field.

2. Description of the Problem

At issue is the construction of a sound reinforcement system which can accept inputs from a large plurality of transducers and non-destructively sum the inputs to produce a sound beam which can be directed to a particular location. Of particular interest is producing a device capable of producing a beam with high acoustic energy intensities. Also of interest is providing a system which produces a highly localized sound field and one in which an listener can enjoy a highly realistic auditory environment, including providing auditory cues corresponding to the listener's locational perspective as presented by a video system.

The parabolic dish is of natural interest at any time focusing and intensification of a propagated field is desired. Meyer et al., in U.S. Pat. No. 5,821,470 described a Broadband Acoustical Transmitting System based on a parabolic reflector incorporating two loudspeaker transducers. One transducer was spaced from the dish, forward along the intended axis of propagation of sound at the focal point of the dish, a conventional arrangement. This transducer was horn loaded and oriented to propagate sound backward along the radiant axis and into the dish for reflection in a collimated beam. The horn loaded transducer was intended to handle the higher frequency components of the overall field. A second transducer for low frequency components was located opposed to the horn loaded transducer on the radiant axis, preferably flush mounted in the dish and oriented for forward propagation of sound. At this location the low frequency transducer would derive relatively little benefit from the dish as such, though the dish would serve as a baffle.

SUMMARY OF THE INVENTION

The invention provides a sound generating and projection apparatus. The apparatus is based on a radiator including at least a first, and possibly additional, shaped reflecting surface (s) having a forward radiant axis. Where more than one reflecting surface is used the radiant axes of the surfaces are coincident. Each shaped reflecting surface defines its own sets of equivalent acoustic input locations, with each set being a ring of non-zero circumference centered on the forward radiant axis. The sound sources used on the focal rings are distributed but functionally continuous sources. In its preferred form, a sound source is, in effect, a line array of loudspeakers disposed in a closed loop. The transducers are disposed in a circle with all of the loudspeakers oriented inwardly toward or outwardly from the forward radiant axis, depending upon which shaped reflecting surface is used.

In its preferred embodiments the radiator includes an inner reflecting surface or both inner and outer reflecting surfaces.

The inner reflecting surface is formed from a cone reflector having its axis aligned on an intended radiant axis. The outer reflecting surface, if present, is a forward concave annular ring disposed around the cone reflector. Preferably the shapes of the reflecting surfaces are parabolic relative to the forward radiant axis and define an inner surface focal ring and an outer surface focal ring. A plurality of transducers is placed along each focal ring with the individual transducers turned into the reflecting surfaces. The transducers are arrayed with spacing between the transducers chosen by reference to the highest intended operating frequency of the device.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 4 is a cross sectional view of the sound generating and transmitting apparatus of a first embodiment of the invention.

FIG. 5 is a plan view illustrating operational divisions of the loudspeaker array for the first embodiment of the invention.

DETAILED DESCRIPTION OF THE INVENTION

Figure 1:
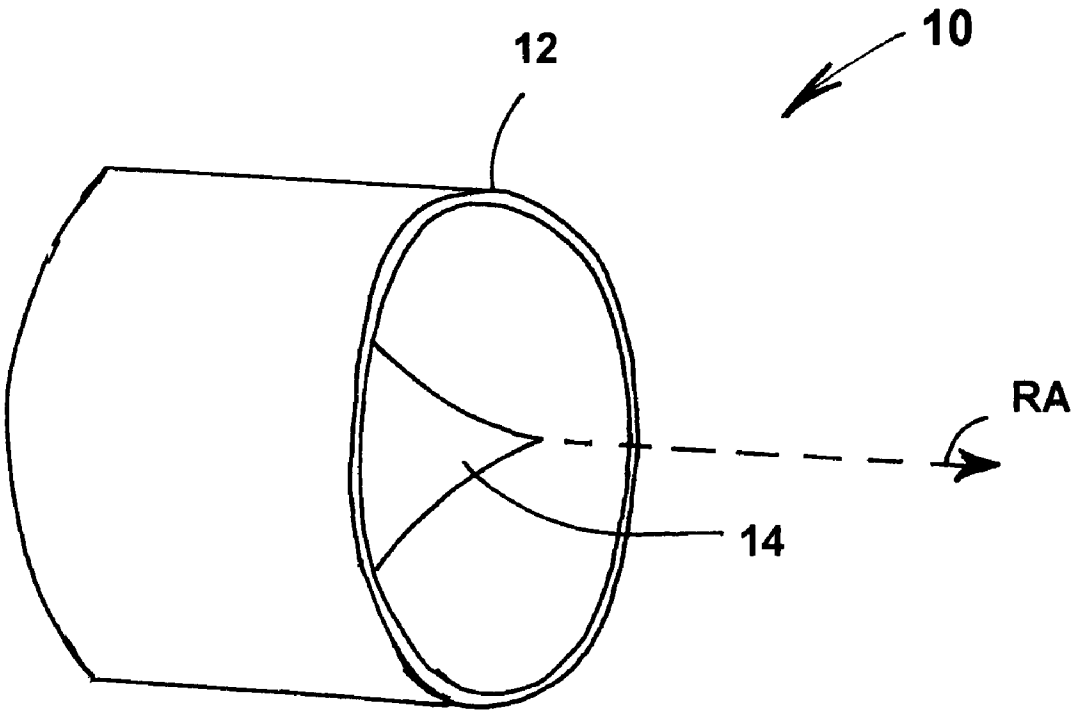
FIG. 1 is a perspective view of a sound projector based on an interior cone reflector.

Referring to the Figures and in particular to FIG. 1 a first embodiment of the invention is illustrated. A sound projector 10 projects a sound field forward on the radiant axis RA of the device. Sound projector 10 incorporates a first reflecting surface formed by a cone reflector 14 mounted inside a cylindrical shell 12 to produce a highly collimated sound field. The central axis of cone reflector 14 lies on the radiant axis RA.

Figure 2:
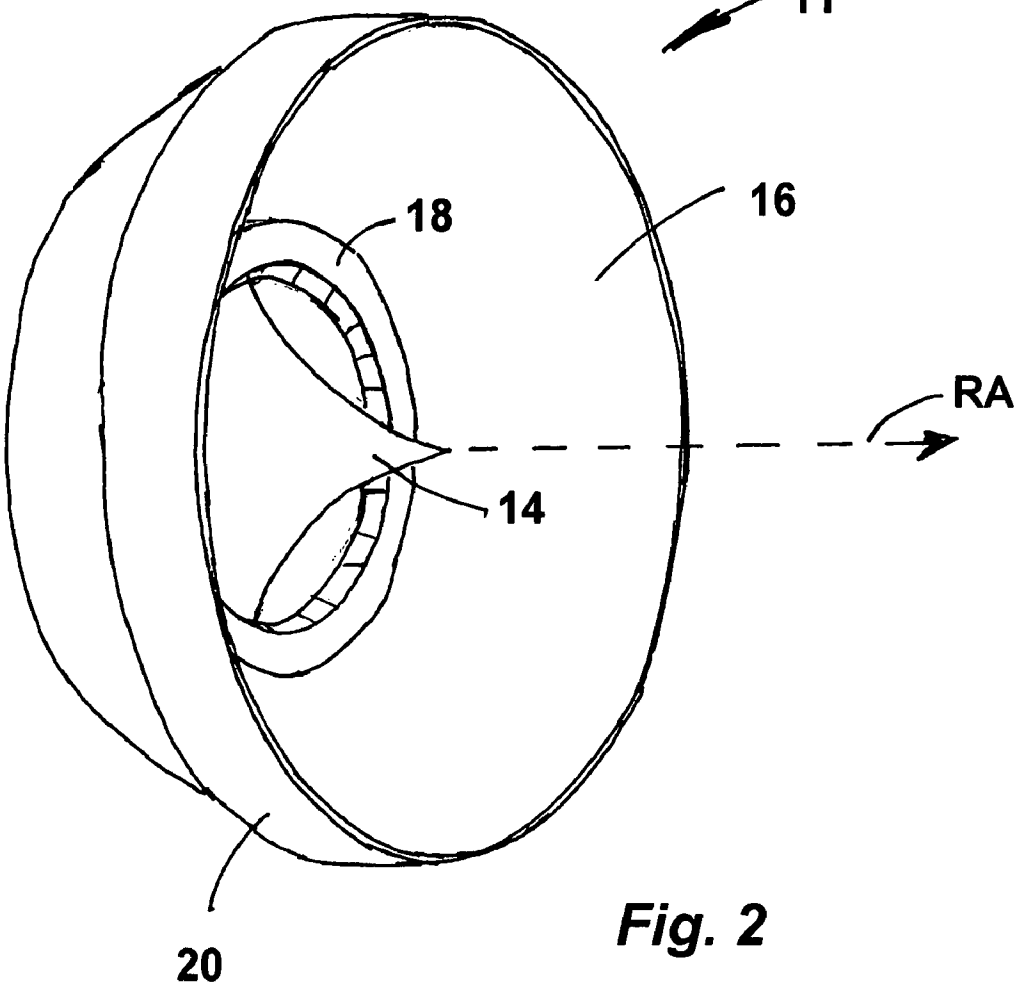
FIG. 2 is a perspective view of a second embodiment sound projector having inner and outer reflecting surfaces with coincident forward radiant axes.

In an alternative embodiment of the invention illustrated in FIG. 2, a sound projector 11 provides two primary acoustically reflective surfaces, the first corresponding to the outer surface of cone reflector 14 and a second surface formed by a forward concave annular ring 16 which is disposed outwardly from and surrounding the cone reflector 14. Both surfaces are housed within a shell 20. Also located within shell 20 circumferentially surrounding and just outside the base of cone reflector 14 is an annular transducer array section 18 from which sound is directed both inwardly on and outwardly from the radiant axis RA against the reflecting surfaces.

Figure 3:
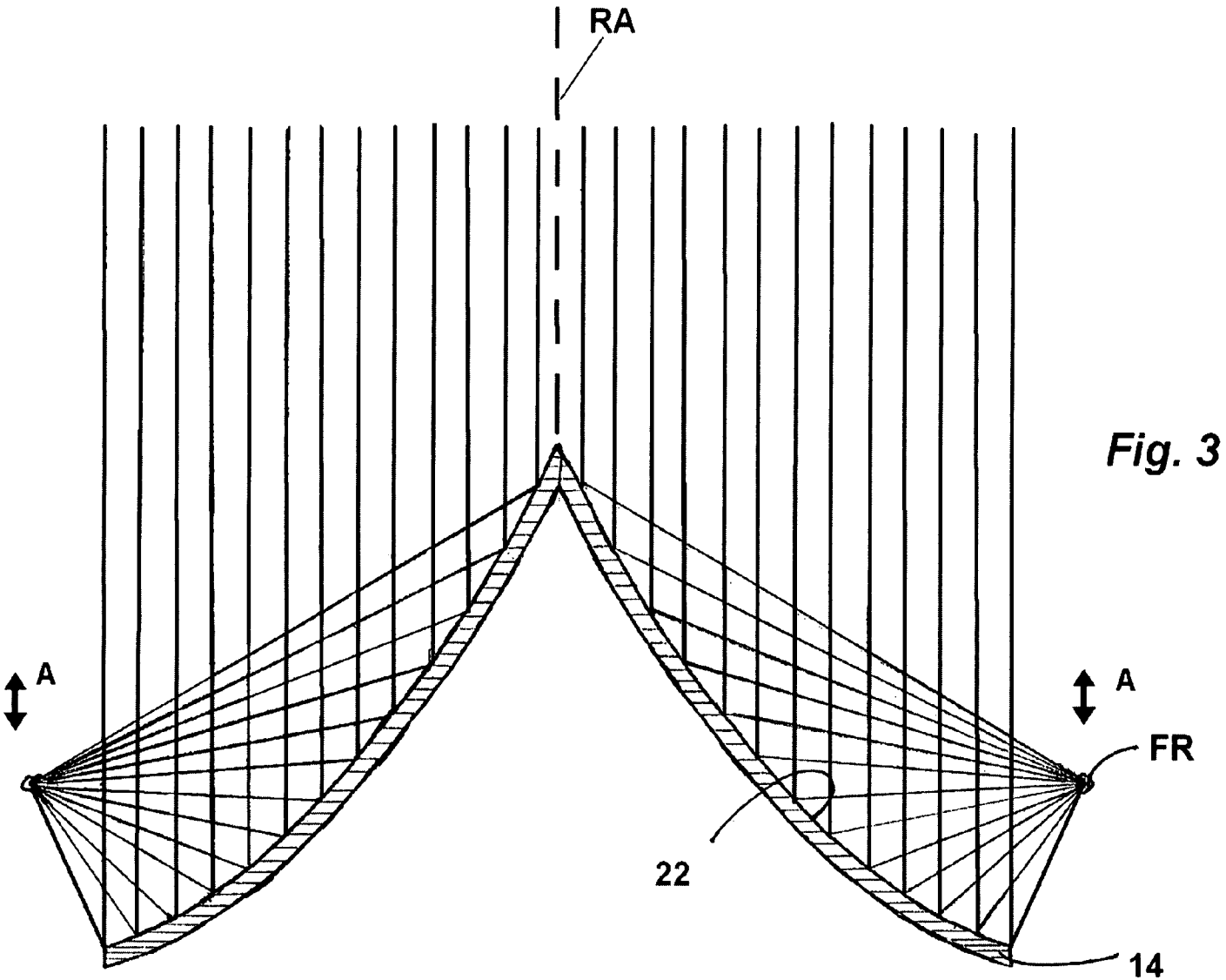
FIG. 3 is a cross sectional diagram depicting operation of an inner reflecting surface for a sound radiator in accordance with the invention.

An advantageous location of the annular transducer array section 18 is illustrated by reference to FIG. 3, which shows a cone reflector 14 which is shaped so that sections of the cone reflector, taken in planes including the radiant axis RA, are parabolic providing a global hyperbolic reflective surface 22 with a focal ring FR. The focal ring FR has a non-zero circumference and surrounds the cone reflector 14 and is centered on the radiant axis RA. Transducers are located on the focal ring of the cone reflector 14 and oriented to direct sound energy against the cone reflector. Such placement of the transducers results in a highly collimated forward sound field exhibiting little dispersion. It might be observed that if the transducers are moved forward and backward parallel to the radiant axis RA (as indicated by double headed arrow A), the field can be made more dispersive, or given a far field convergence point forward from cone reflector 14.

FIG. 4 illustrates placement of a plurality of loudspeaker transducers 26 at discrete, evenly spaced locations along a focal ring surrounding cone reflector 14. In the illustrated embodiment the loudspeakers 26 are directed inwardly on the radiant axis RA with generated sound being reflected forward along the radiant axis in a low dispersion collimated beam. Some leakage occurs toward the tip of the cone reflector 14 due to lack of reflective surface area. In some embodiments a substantial portion of the tip of cone reflector 14 may be dispensed with. Loudspeakers 26 are arranged in what is in effect an annular, closed loop line array 24, with the loudspeakers 26 installed in a sealed enclosure 30 and emitting sound through an annular baffle 28. Loudspeakers 26 are located discretely spaced from one another by no more than one quarter of a wavelength of the highest intended operating frequency of the device.

Figure 6:
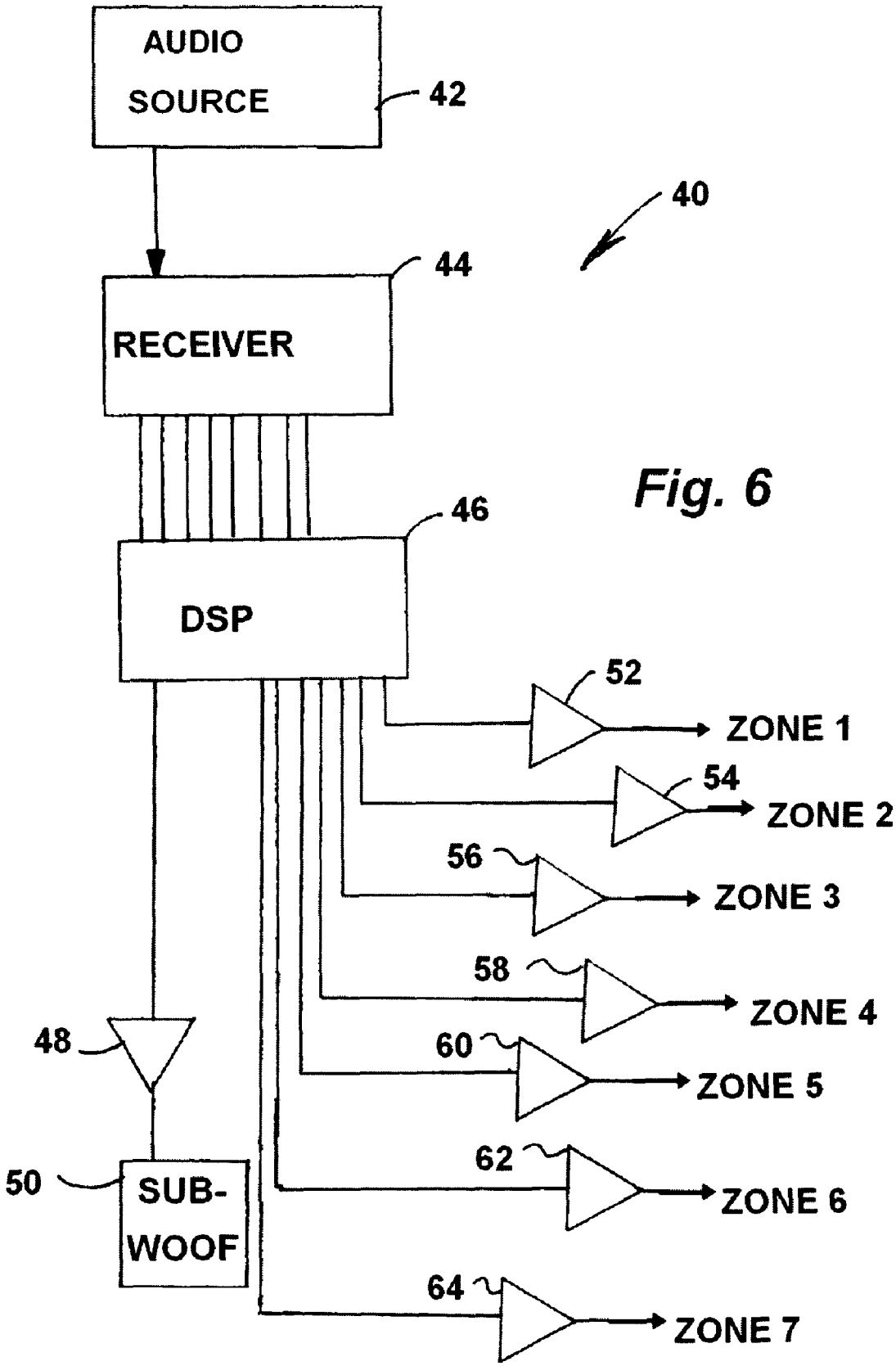
FIG. 6 is a high level schematic of circuitry for the sound projector of FIG. 5.

It is not necessary that every loudspeaker 26 be part of the same channel. An extraordinarily rich surround sound system can be provided a listener located directly forward of the unit by dividing the array into zones. FIG. 5 illustrates division of the transducers 26 of an array into eight zones. The zones are categorized by a visual context to provided the listener by an associated video system (See FIG. 7). The direction "forward" from the observer, that is the expected focus of interest in a field of view, may be correlated with center zone 32 (zone 2). Moving clockwise around the array are provided successively: a right front zone 33 (zone 3); a right side zone 34 (zone 4); a right rear zone 35 (zone 5); a stub rear zone 36 (zone 5/6) to which may be applied a mix of the signals from the fifth and sixth channels; a left rear zone 37 (zone 6); a left side zone 38 (zone 7); and a left front zone 31 (zone 1). Each zone receives its own input channel as illustrated in FIG. 6. In FIG. 6, for purposes of the exemplary block diagram circuit 40, it is assumed that an audio signal is provided from a DVD player 42 or comparable source. The audio signal is applied to a receiver 44 for recovery and division into the basic set of channels. Each channel is applied to a digital signal processor 46 and from there the preamplifier 48, 52, 54, 56, 58, 60, 62, 64 for each channel plus the subwoofer 50 channel.

Figure 7:
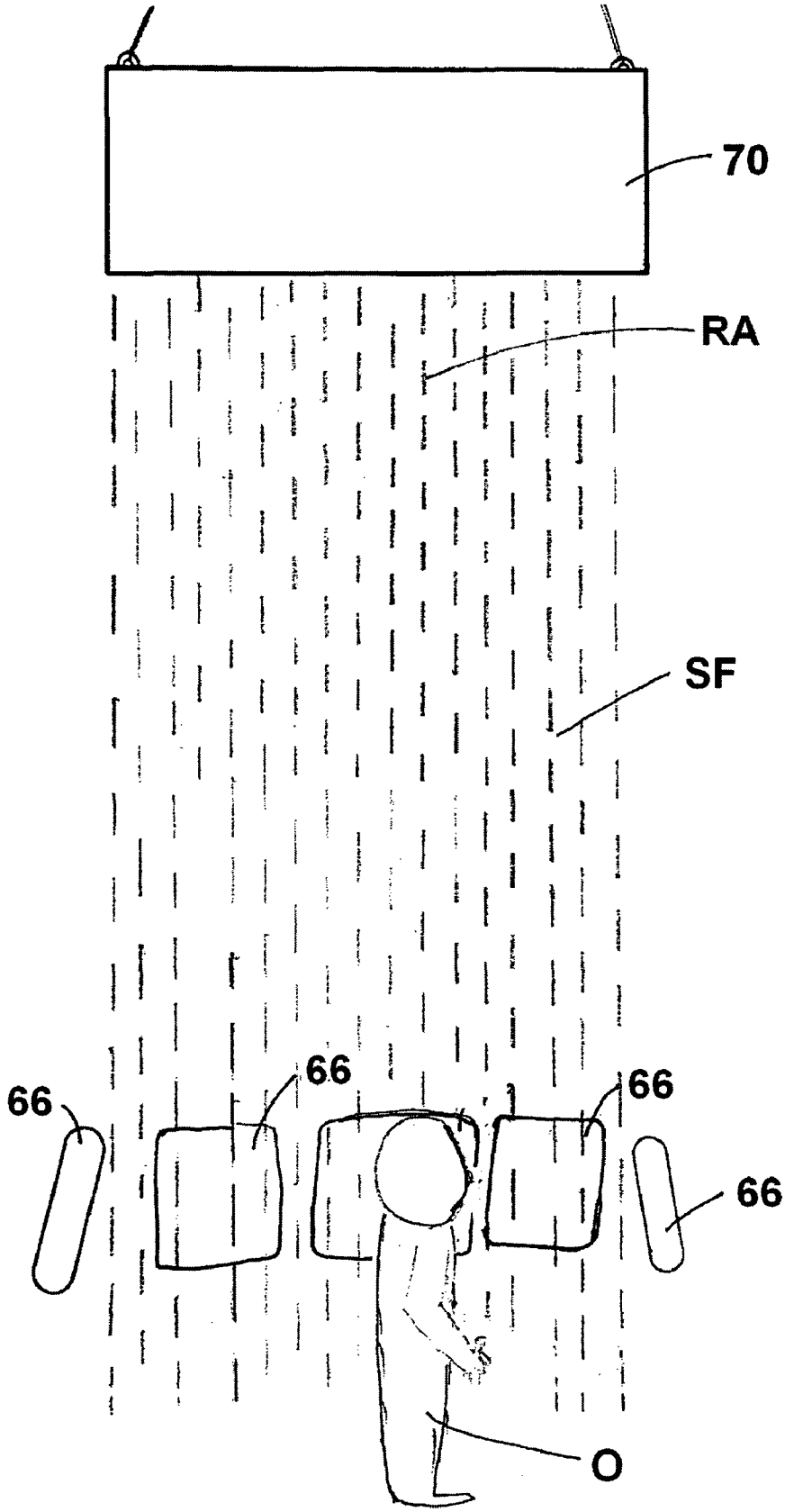
FIG. 7 illustrates an application for the embodiment of the invention illustrated in FIGS. 5 and 6.

FIG. 7 illustrates how a listener O may be positioned relative to a sound projector 70 incorporating a cone reflector 14 and zonal division of its transducer array. A sound field SF is produced which provides a surround sound experience oriented based on the visual context provided by video devices 66.

Figure 9:
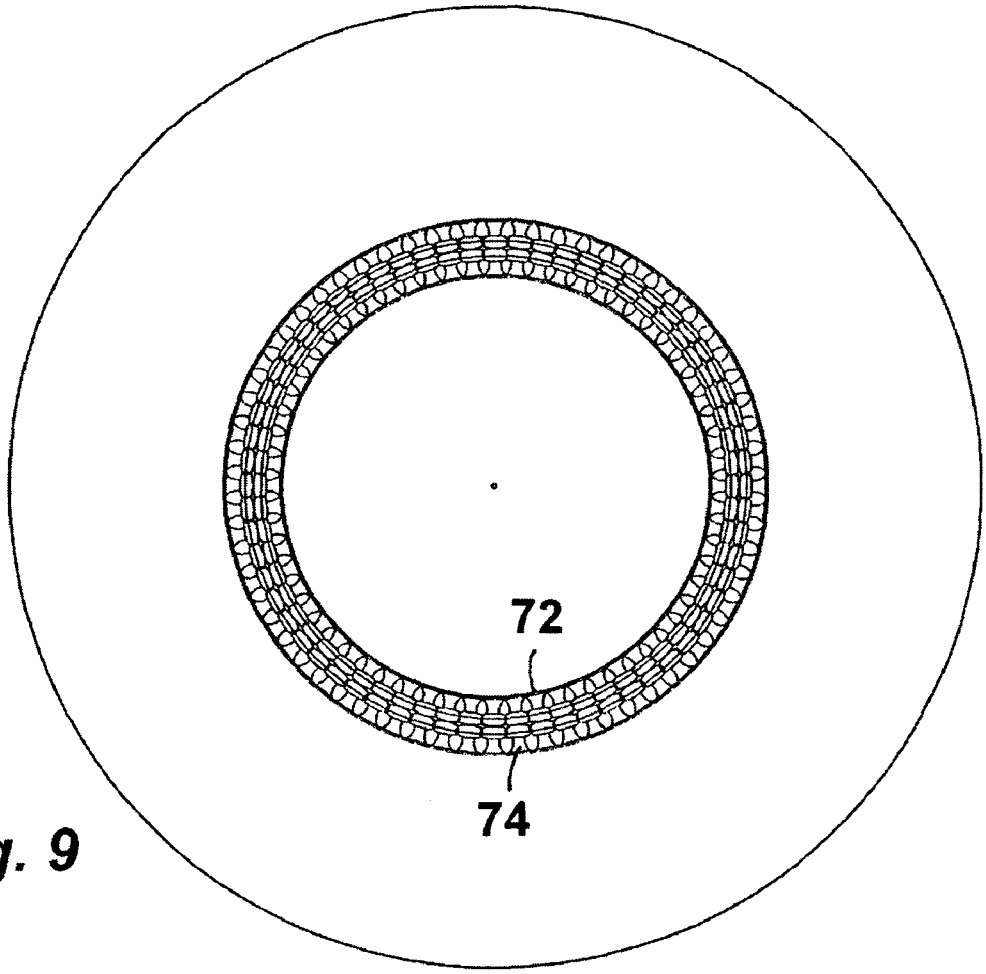
FIG. 9 illustrates an arrangement of high frequency transducer elements for the projector of FIG. 8.
Figure 8:
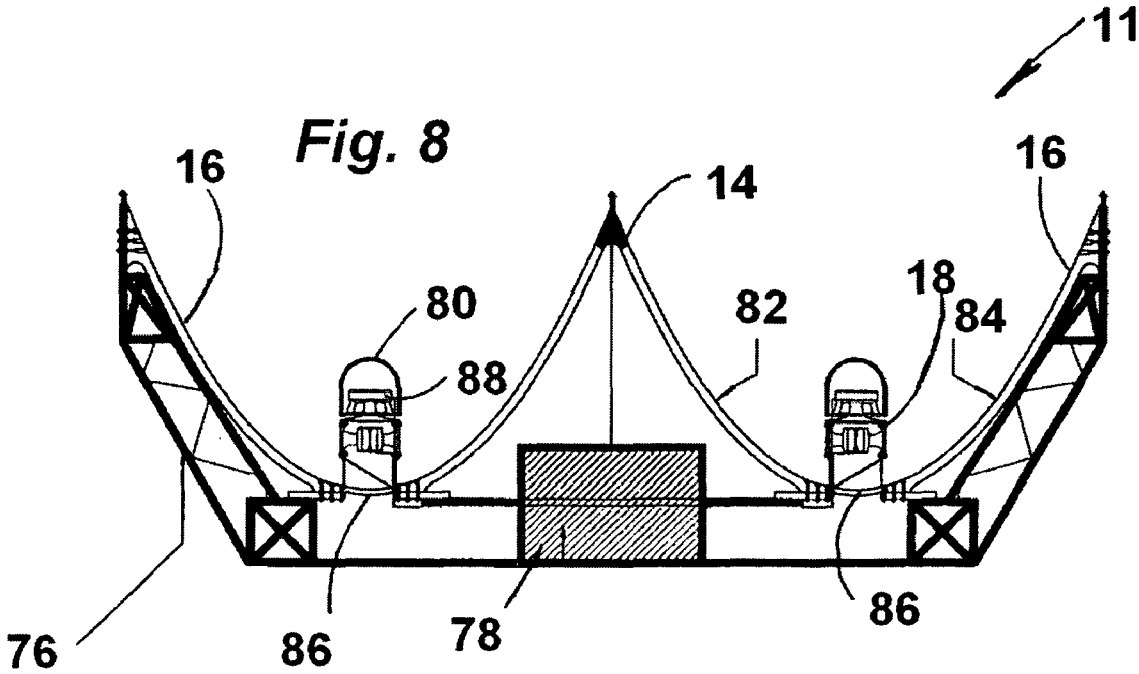
FIG. 8 is a cross sectional illustration of a embodiment of the invention having first and second reflecting surfaces.
Figure 10:
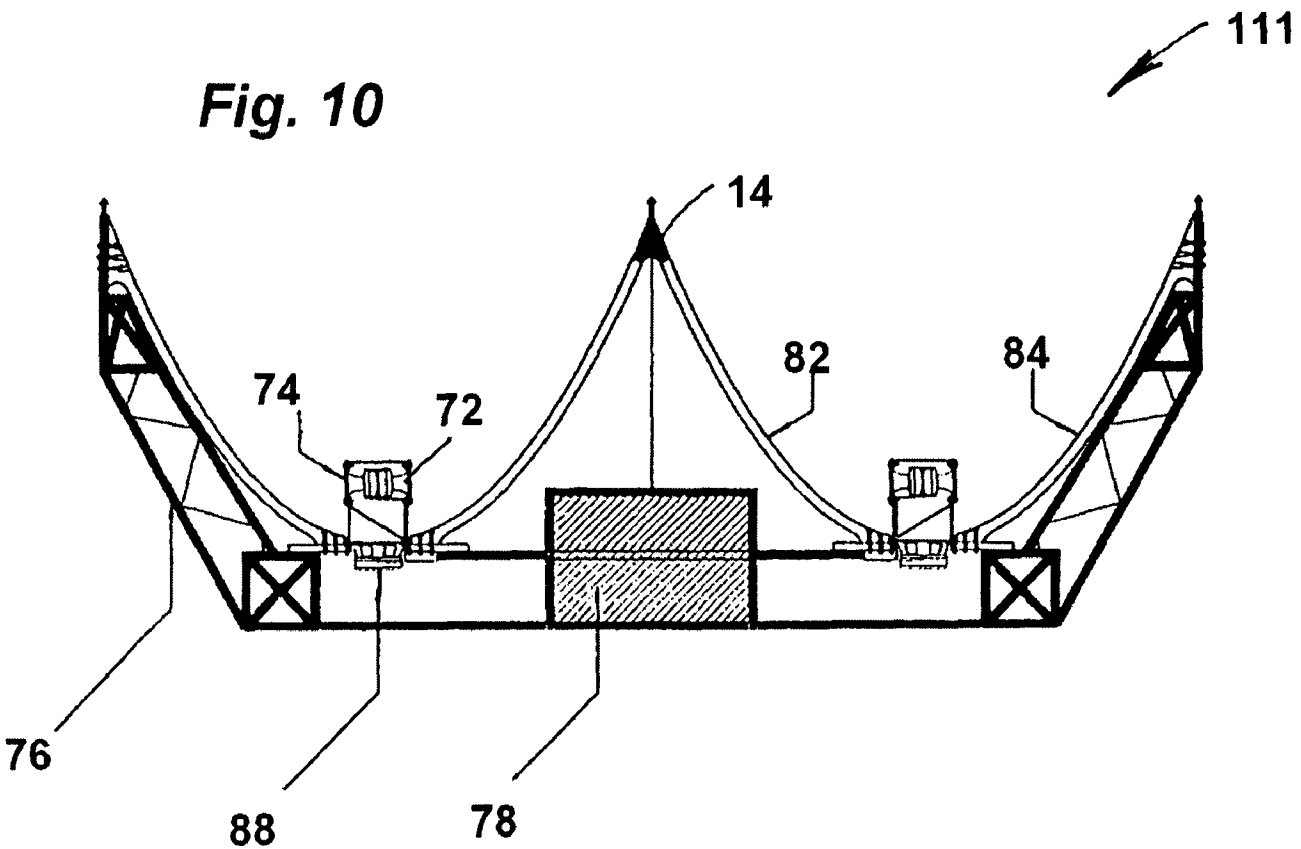
FIG. 10 is a cross sectional view of a variation of the projector of FIG. 8.
Figure 11B:
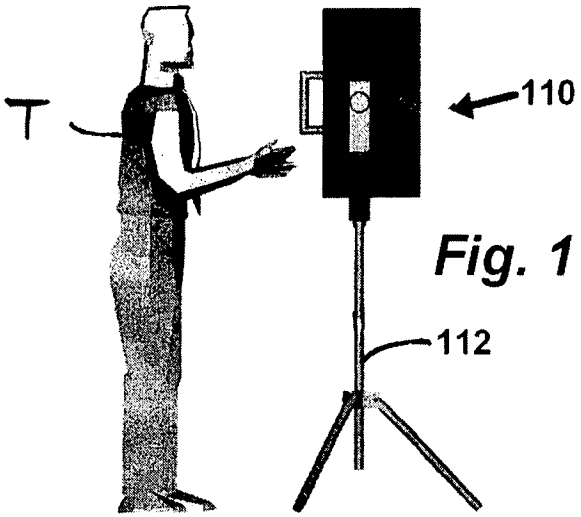
FIGS. 11A-D are, respectively, a top plan, a side elevation, a front elevation and a perspective view of a portable sound projector incorporating the radiator and toroidal radial array of the invention.
Figure 11D:
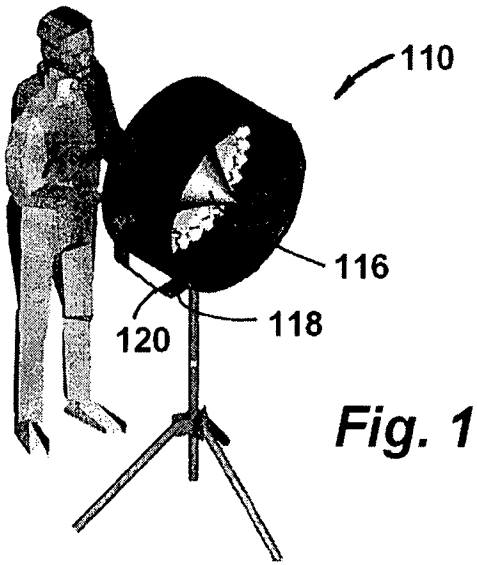
Figure 11A:
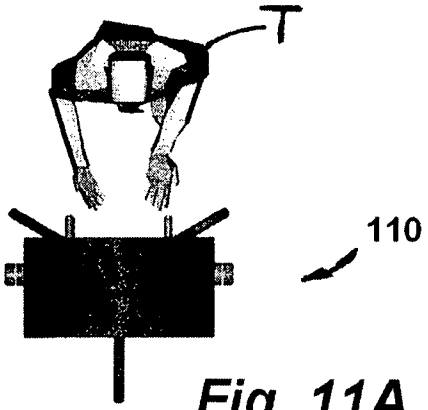
Figure 11C:
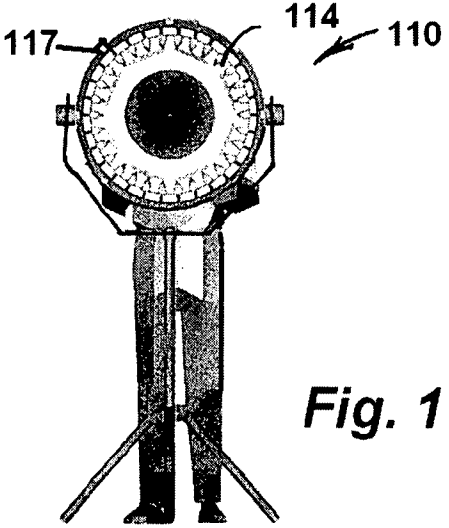

Referring to FIGS. 8-10 an alternative embodiment of the invention is illustrated incorporating a reflector with inner and outer reflecting surfaces. The inner reflecting surface 82 is provided by the cone reflector 14, which is preserved from the first embodiment of the invention. A second, outer reflecting surface 84 is provided by a forward concave annular ring 16. Outer reflecting surface 84 is preferably parabolic in its sections, but differs from a conventional parabolic dish in that the bases of the parabolic sections to not meet at a single point in the base of the dish, but instead surround an annular gap in which cone reflector 14 may be placed. The term "parabolic" is intended to include functionally equivalent surfaces constructed from flat segments which average to a parabola. The term parabola is applied to curves of the reflecting surfaces in planes. The overall reflective surfaces are considered hyperbolic because they do not have focal points but rather "focal rings". In addition, outer reflecting surface 84 would function without inner reflecting surface 82, though such an arrangement would have a larger than necessary footprint.

In FIGS. 11A-D an application of sound projector 110 mounted on a tripod 112 is illustrated from various perspectives and contrasted in size with an operator T, who may be taken as standing about 6 feet in height. The aperture A of projector 110 is about 30 inches and exposes a radial toroidal array 114 disposed around the base of cone reflector 116. Sound projector 110 is installed on an altazimuth mount 118 which allows rotation on the tripod 112 base to control azimuth and pivoting on a fork 120 to control altitude. A gun sight type element 117, potentially including a camera for remote control, may be provided to aim sound projection 110.

Figure 12A:
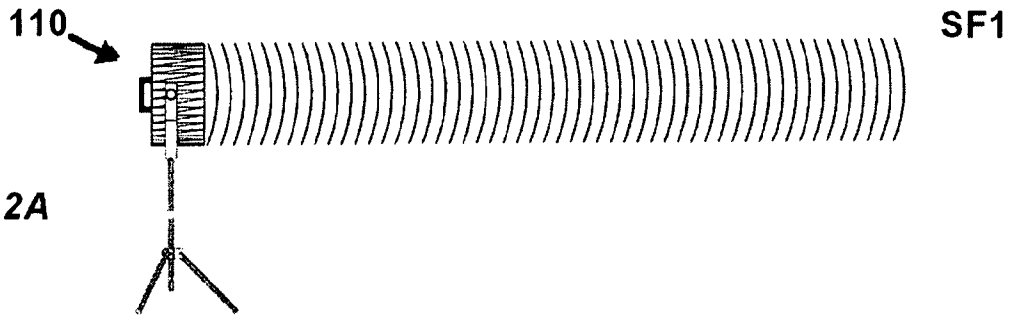
FIGS. 12A-C are side elevations illustrating characteristic dispersion for sound fields produced by the projector of FIGS. 11A-D.
Figure 12B:
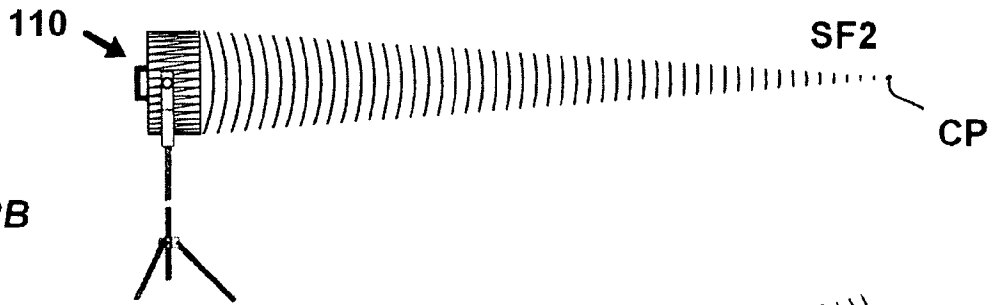
Figure 12C:
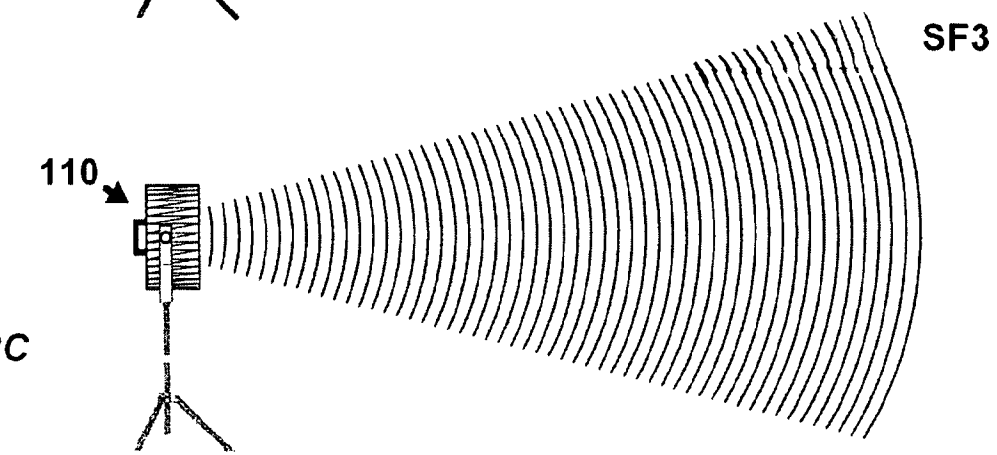
Figure 13:
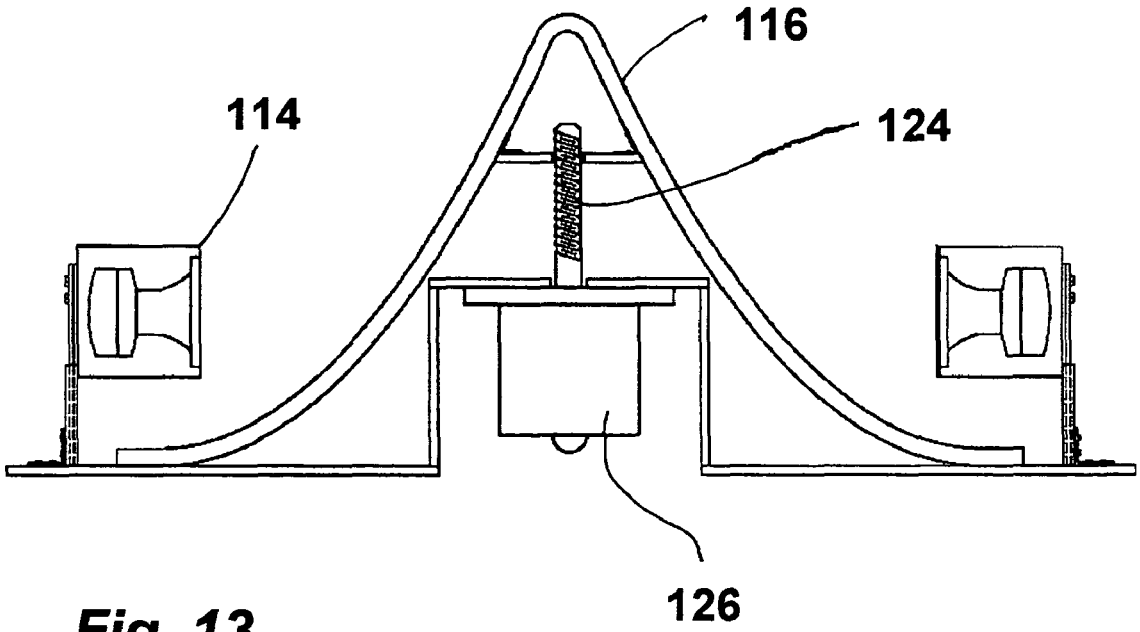
FIG. 13 is a cross sectional view of the radiator and loudspeaker array of the projector of FIGS. 11A-D.

In FIGS. 12A-C the characteristic sound field dispersions illustrating a polar sound field SF1, a focused sound field SF2 with a far field convergence CP and a sound field SF3 with 30 degrees of dispersion. Far field convergence CP and the angle of dispersion are selectable using the mechanism of FIG. 13. For a hyperbolic cone reflector 116 which, by virtue of its parabolic sectional shape has a focal ring, the dispersion characteristics of a forward projected sound field are controllable by relative movement of the toroidal radial array 114 parallel to the radiant axis of the reflector. This of course can be achieved by movement of either the array 114 or the reflector 116. As illustrated the reflector has been equipped with a worm drive 124 driven by a simple servo actuator motor 126 for displacing the cone reflector 116 relative to the ring array 114. The worm drive 124 could also drive a pointer to a graph indicating neutral, dispersion angle and meters to the convergence point. Naturally the system could be equipped with sophisticated range finding allowing automation of focus selection once a target had been selected by an operator.

The parabolic section for a hyperbolic cone reflector follows the equation:

$$Y=X^2/4F$$

where F is the focus, X is width and Y is height. Non-parabolic section curves are conceivable, as is a cone reflector with flat faces. Most such faces would not provide focusing as do the preferred hyperboloids.

Figure 14:
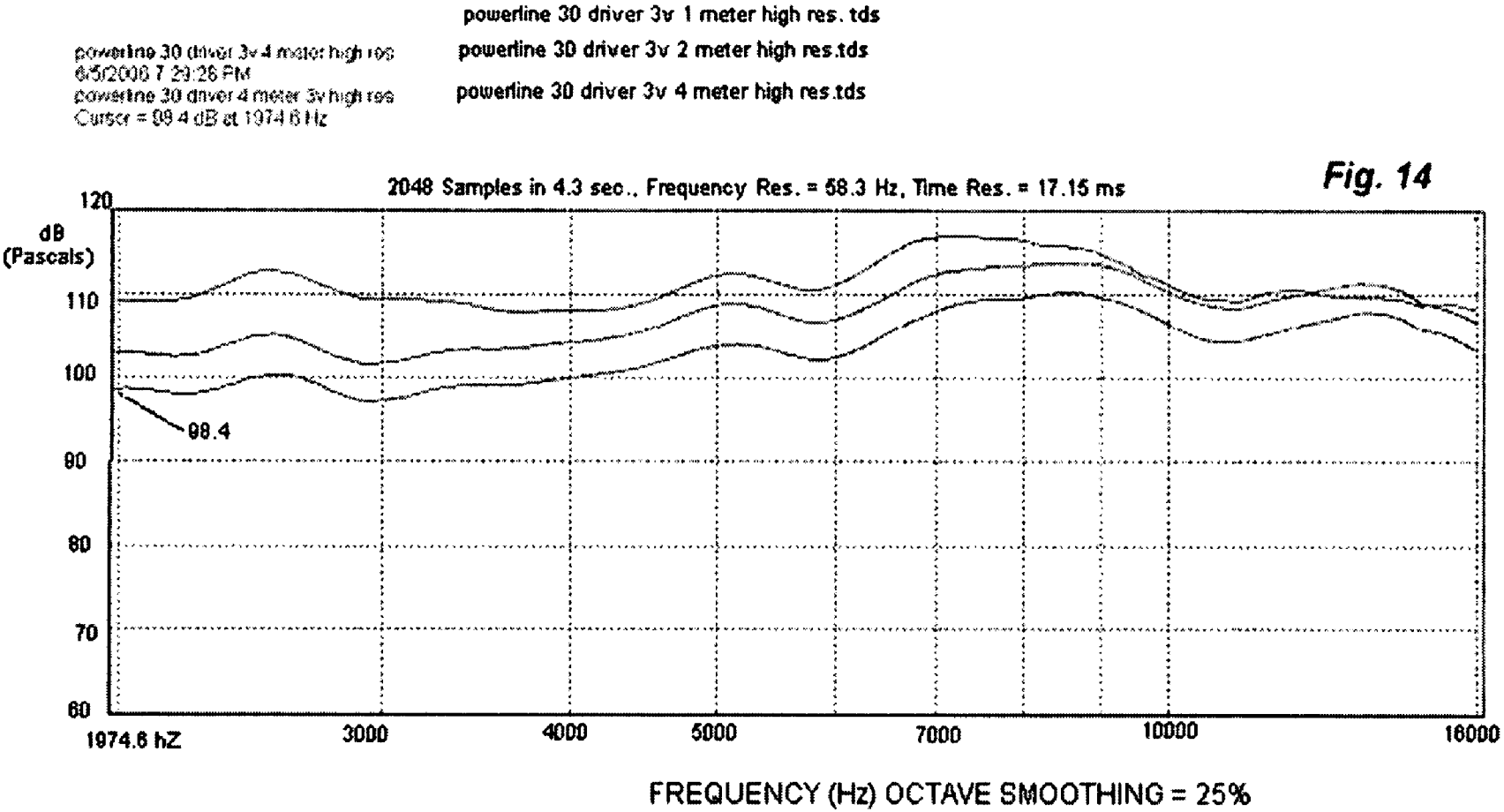
FIG. 14 is a graph of frequency response over distance for a representative system incorporating the invention.

FIG. 14 illustrates frequency response over distance for a representative system incorporating the invention by a series of response curves, each representing a doubling of distance over the next higher curve along the center radiant axis of the projector. The projector response follows a near inverse square (−6 db per doubling of distance) in the lower frequencies but a substantially smaller drop at higher frequencies. In the highest frequency bands the output of the projector can be focused to a beam waist in a manner analogous to light allowing higher outputs at distance than close to the device. The lowest frequency knee point of the coherent focus phenomena is a function of the hyperboloid shape and the diameter (which effects the available surface area) of the cone reflector used. The larger diameter used the lower the frequency obtainable for coherent focus. The kneepoint wavelength seems to be about 4× the diameter of the cone reflector. The reflector works at lower frequencies, but outputs follow the inverse square law.

Figure 15:
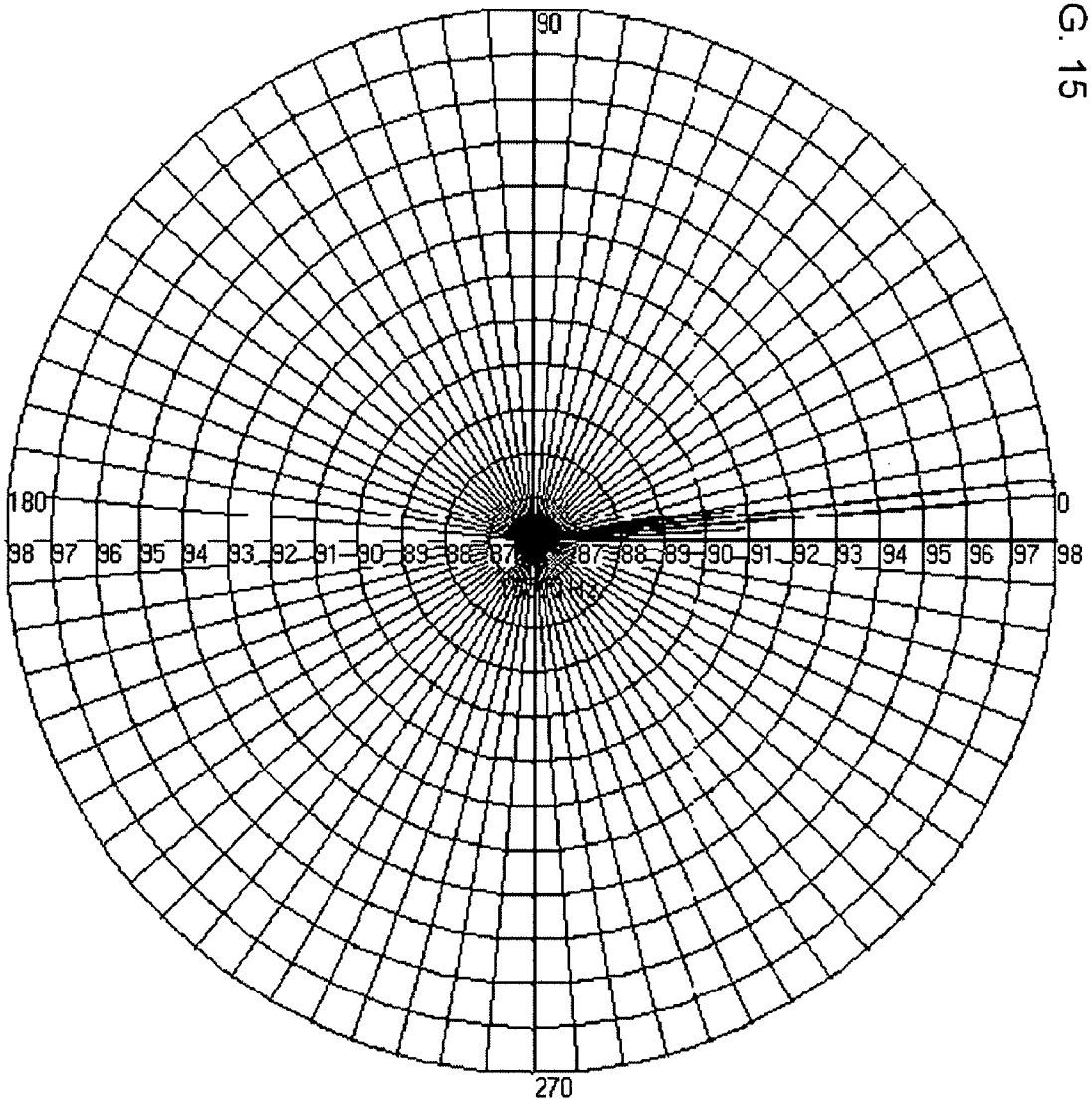
FIG. 15 is a polar graph of the conical output.

FIG. 15 is a polar graph for a radiator having a hyperbolic reflector and an 18 inch diameter and shows a 2 to 3 degree dispersion centered on the radiant axis of the device (0 degrees). The strongest line is just counterclockwise from 0 degrees (at 2 degrees) at the 97.5 db output level. The other eight lines are substantially less at the 90 to 91 db range and vary to both sides of the 0 degree line. The larger the diameter of the hyperboloid reflector the greater the degree of coherent focus obtainable. A 12 inch diameter device obtains 6 to 7 degrees of dispersion while a 48 inch device has less than 1 degree of dispersion in its usable bandwidth.

Figure 16:
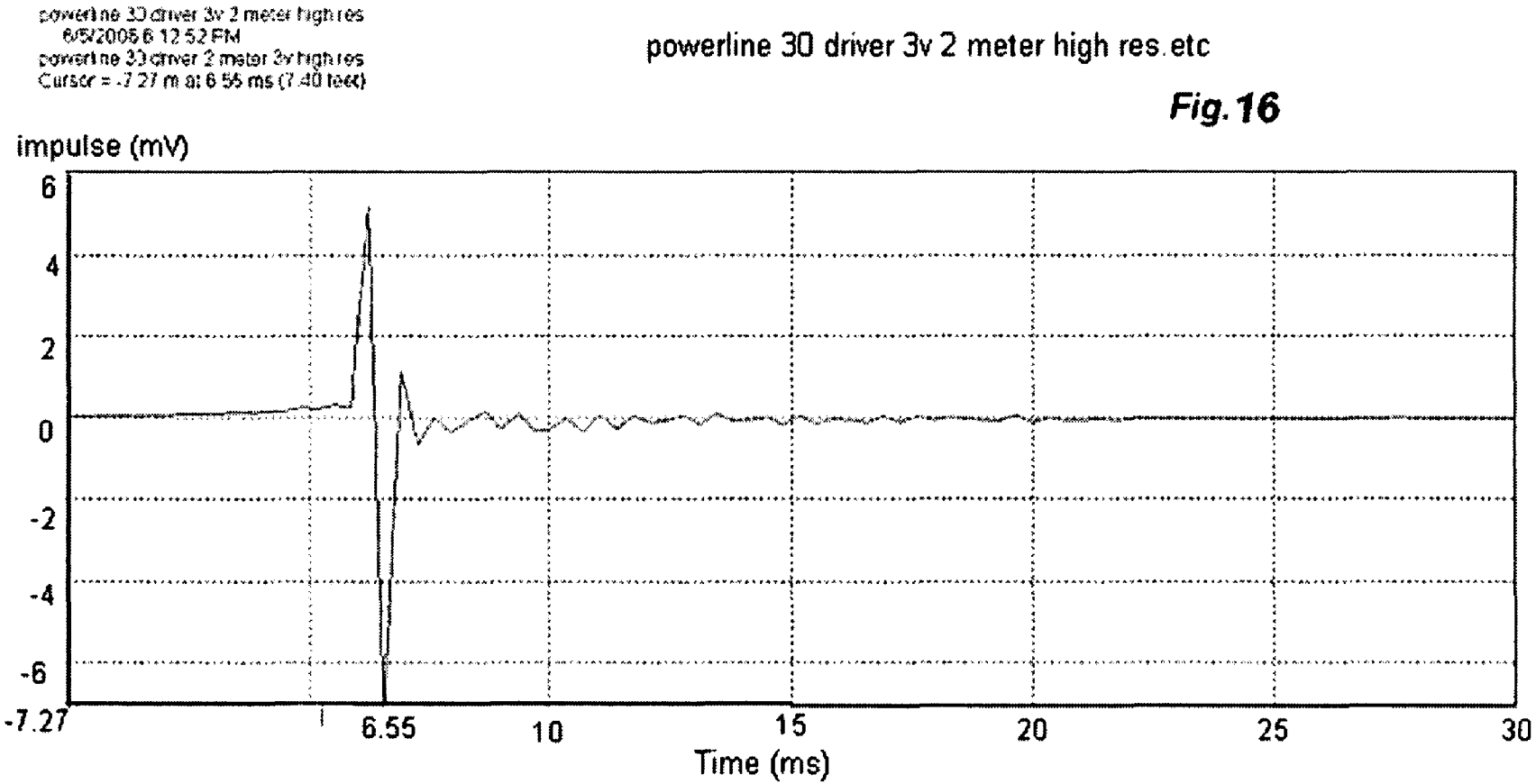
FIG. 16 is a impulse response graph.

FIG. 16 is an impulse response graph showing that a sound beam produced by the device has almost no resonance relegated energy.

Figure 17:
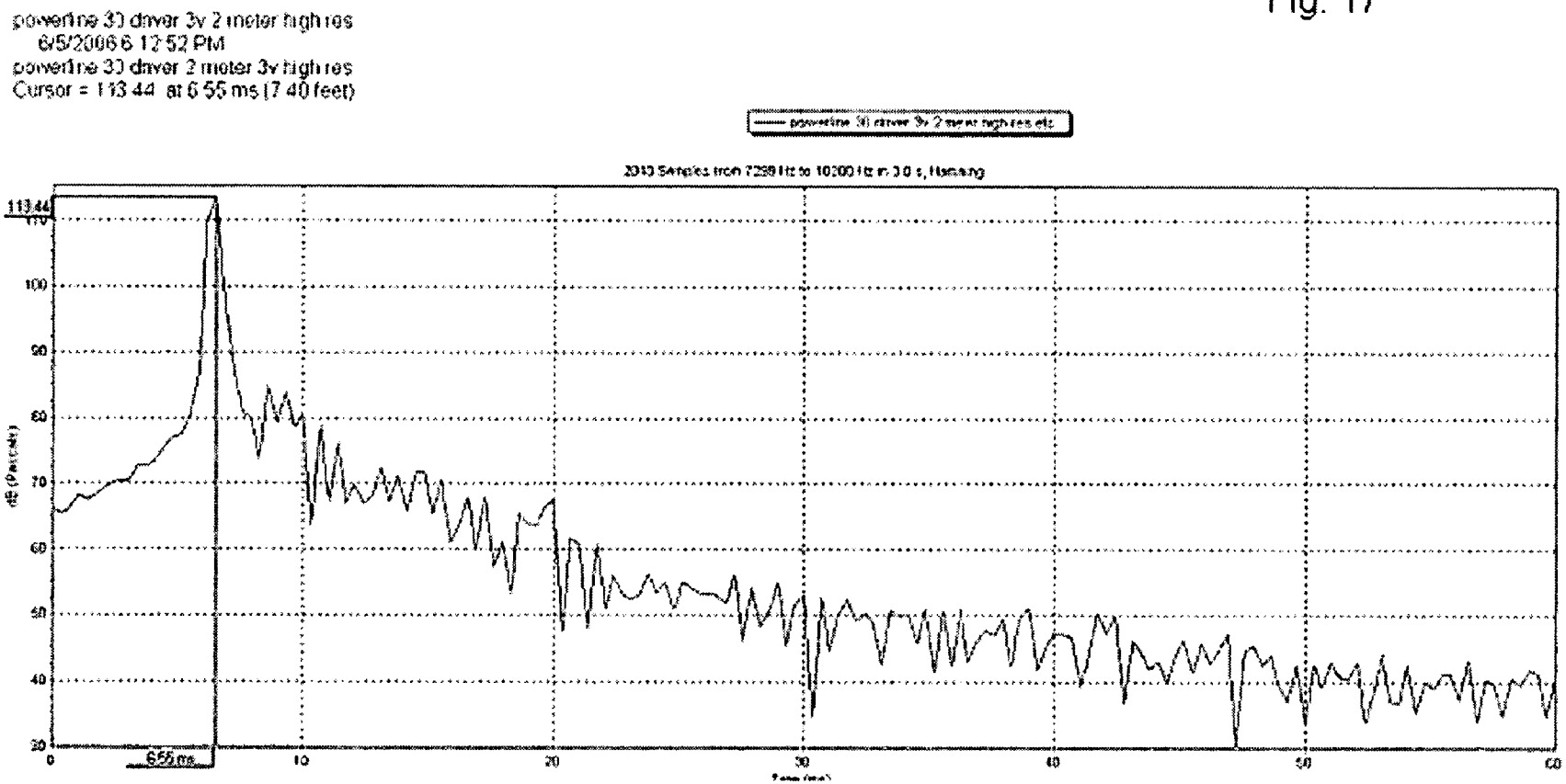
FIG. 17 is a time over energy graph.

FIG. 17 is a graph of time versus energy. Showing an extremely sharp peak in the pulse defining the precise time alignment of a system incorporating 30 loudspeakers in a toroidal radial array. Again a high degree of coherence of the summation of multiple sources into a single beam with high efficiency.

Figure 18:
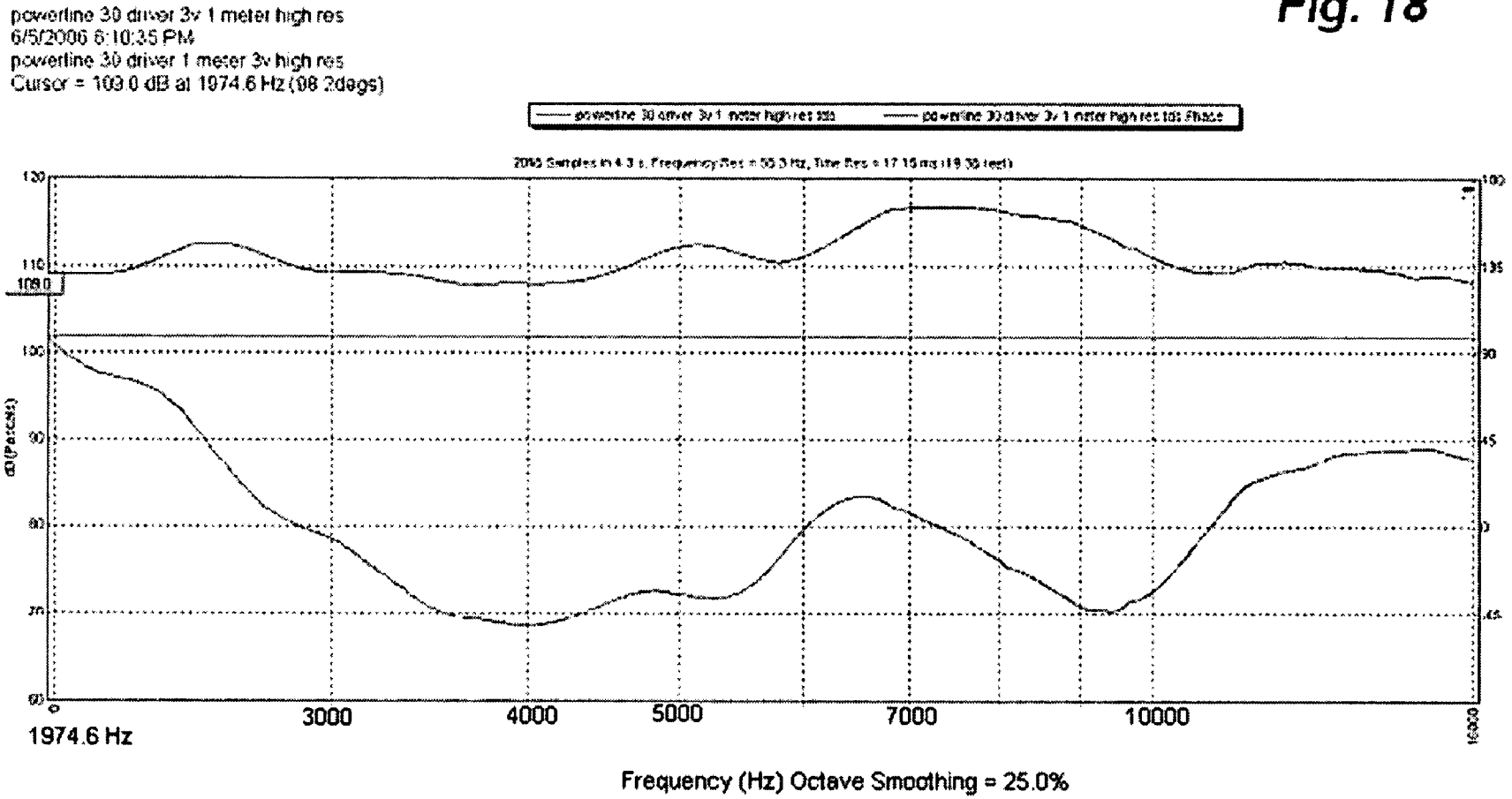
FIG. 18 illustrates phase and energy over frequency.

FIG. 18 illustrates phase (bottom curve) and energy (top curve) over usable frequency (12 Khz to 23 Khz) for a system using 30 input sources. Typically high efficiency horn loaded loudspeakers exhibit several hundred degrees of phase shift over their operating range, however here the total phase shift over used bandwidth is less than 150 degrees. This result is highly consistent with very precise and linear high amplitude output.

The present invention provides a sound system which allows inputs from a potentially large plurality of sources located at acoustically equivalent locations with non-destructive summing of the sources to produce a collimated sound field. In some embodiments different zones within the sound field can be used to produce a rich surround sound environment keyed to visual ques provided over visual display devices.

While the invention is shown in only a few of its forms, it is not thus limited but is susceptible to various changes and modifications without departing from the spirit and scope of the invention.

What is claimed is:

1. A sound generating and transmitting apparatus comprising:

a radiator including inner and outer reflecting surfaces, the inner reflecting surface being formed on a cone reflector and the outer reflecting surface being a forward concave dish disposed around the cone reflector, the shaped reflecting surfaces defining sets of equivalent acoustic input locations in first and second focal rings of non-zero circumference;

plurality of sound sources positioned in either a set of equivalent acoustic input locations for the first focal ring or a set of equivalent acoustic input locations for the second focal ring to provide a pair of distributed, functionally continuous sounds sources, one sound source being oriented to radiate sound inwardly against the cone reflector and a second sound source being oriented to radiate sound outwardly against the forward concave dish;

the distributed, functionally continuous sound sources being arrays of discrete acoustic transducers arranged in closed loops; and coincident forward radiant axes for the inner and outer reflecting surfaces.

2. The sound generating and transmitting apparatus as claimed in claim 1, further comprising:

the outer reflecting surface having parabolic sections in planes including the coincident forward radiant axes and the focal ring for the outer source being of non-zero circumference and located inside the outer reflecting surface and admitting a plurality of equivalent acoustic input points distributed along the focal ring for the outer reflecting surface.

3. The sound generating and transmitting apparatus as claimed in claim 1, further comprising:

the inner reflecting surface having parabolic sections in planes including the coincident forward radiant axes and the focal ring of non-zero circumference being outside the inner reflecting surface and admitting a plurality of equivalent acoustic input points distributed along the focal ring.

4. The sound generating and transmitting apparatus as claimed in claim 1, further comprising:

the inner reflecting surface having parabolic sections in planes including the coincident forward radiant axes and the focal ring for the inner reflecting surface being of non-zero circumference and located outside the inner reflecting surface admitting a plurality of equivalent acoustic input points distributed along the focal ring; and the outer reflecting surface having parabolic sections in planes including the coincident forward radiant axes and the focal ring for the outer surface being of non-zero circumference and located inside the outer reflecting surface and just outside of the focal ring for the inner reflecting surface admitting a plurality of equivalent acoustic input points distributed along the focal ring.

5. The sound generating and transmitting apparatus as claimed in claim 4, further comprising:

a forward directed plurality of bass transducers located aligned on the focal rings.

6. The sound generating and transmitting apparatus as claimed in claim 5, further comprising:

the discrete acoustic transducers being horn loaded.

* * * * *